US005404210A

United States Patent [19]

Day

[11] Patent Number: 5,404,210

[45] Date of Patent: Apr. 4, 1995

[54] CONTINUOUS PURIFICATION OF LIQUID TONERS

[75] Inventor: Gene F. Day, Hillsborough, Calif.

[73] Assignee: Phoenix Precision Graphics, Inc., Sunnyvale, Calif.

[21] Appl. No.: 204,884

[22] Filed: Mar. 2, 1994

Related U.S. Application Data

[63] Continuation of Ser. No. 973,837, Nov. 9, 1992, abandoned.

[51] Int. Cl.[6] ..... G03G 15/10

[52] U.S. Cl. ..... 355/256; 118/659; 430/117

[58] Field of Search ..... 355/256, 257, 326, 327; 118/645, 659, 660, 652; 430/117–119, 45

[56] References Cited

U.S. PATENT DOCUMENTS

| | | | |
|---|---|---|---|
| 3,910,231 | 10/1975 | Inoue et al. | 355/256 |
| 4,627,705 | 12/1986 | Landa et al. | 355/327 |
| 4,640,605 | 2/1987 | Ariyama et al. | 355/256 |
| 4,796,051 | 1/1989 | Monkelbaan et al. | 355/326 |
| 4,799,452 | 1/1989 | Day | 118/645 |
| 4,800,839 | 1/1989 | Ariyama et al. | 118/691 |
| 4,870,462 | 9/1989 | Day | 355/256 |
| 4,895,103 | 1/1990 | Day | 118/652 |
| 4,923,581 | 5/1990 | Day | 204/180.1 |
| 4,985,732 | 1/1991 | Landa et al. | 355/256 |
| 4,987,429 | 1/1991 | Finley et al. | 346/157 |
| 5,036,365 | 7/1991 | Landa | 355/256 |

*Primary Examiner*—Robert B. Beatty
*Attorney, Agent, or Firm*—Schneck & McHugh

[57] ABSTRACT

An electrostatic color printer or copier having a single toner applicator with a system for continuous toner purification. The single applicator is used for each color sequentially and as toning of one color is completed a volume of spent or contaminated toner fluid is left behind in the applicator. This volume is removed with clean wash fluid and sent to a wash fluid tank. Dirty wash fluid is continuously purified either before or after return to a wash fluid supply tank. In the latter case, the wash fluid supply becomes contaminated but is purified as wash fluid is withdrawn or while still in the tank. Continuous purification of dirty wash fluid allows a small volume purifier to be used without need for spent toner disposal.

9 Claims, 4 Drawing Sheets

CONTINUOUS PURIFICATION OF LIQUID TONERS

The present application is a continuation of U.S. application Ser. No. 07/973,837, filed Nov. 9, 1992, now abandoned.

TECHNICAL FIELD

The invention relates to electrostatic printing and copying and, more particularly, to a method of supplying liquid toner for such processes.

BACKGROUND ART

Disposal of spent toners has long been a major problem for users of electrostatic printers and plotters. Today, ever increasing environmental awareness together with proliferating governmental regulations relating to chemical disposal are beginning to threaten use of liquid toners altogether. Despite the fact that the materials used for modern liquid toners are relatively harmless, the costs associated with proper disposal and documentation are threatening to render the technology noncompetitive in the marketplace.

A method already exists, in principle, for eliminating the need for liquid toner disposal. This is described in U.S. Pat. Nos. 4,799,452; 4,895,103 and 4,923,581, all to G. F. Day. In this method the toner itself is eliminated except for a transitory existence just at the moment of toning. Concentrated "ink" of each color is stored in a small tank and injected into and mixed with a continuous stream of clear carrier fluid. The resulting toner stream is passed through the toner applicator and then immediately decomposed back into concentrate and clear fluid. This is done electrophoretically with a "separator", described in the patents. To stop the toning process the injection of the selected concentrate is simply terminated.

It would seem that this recycling concept might provide a liquid toning technology free of disposal problems since a large volume of contaminated or spent toner would never exist. However, the basic cause of disposal is not eliminated. Eventually the contents of the concentrate tanks would have to be discarded due to contamination. This is because the contaminants are re-mixed with the carrier fluid along with the colored toner particles and never removed from the system. The quantity of liquid to be thrown away would, to be sure, be smaller, but some fluid disposal problems would still remain. Also, the recycling architecture is relatively complex. It requires precise metering and mixing of two fluid streams and, worse, high speed separation of the toner into its components as it flows out of its applicator. With the high flows which are characteristic of full-width toner applicators, the separation apparatus must be quite large and, therefore, costly.

In order to electrophoretically separate a toner stream into its components the fluid is passed between two closely spaced, parallel electrodes while a high voltage is imposed across the gap. All of the fluid must be exposed to the full electric field and this means the flow must normally be confined to the gap region with some kind of fluid seals along the lateral edges of the separation zone. One of the electrodes must also be moving so that the accumulating sludge can be scraped off and sent to the appropriate concentrate tank. The seals which confine the fluid flow within the gap present numerous technical difficulties. They must support the high voltage and this high voltage appears across the exposed surface of the seal which joins the two electrodes. Surface electrical breakdown keeps the applied voltage lower than would otherwise be desired and this, in turn, causes the separator to be yet larger in order to assure total separation of the solids from the clear fluid. Also, four such large separators are normally required for a four color system.

An object of the invention was to devise a more effective method of providing disposal-free liquid toner than prior art recycling methods.

SUMMARY OF THE INVENTION

The above object has been achieved with a toner supply method and system which eliminates toner disposal more completely than recycling and which is much less costly to implement. A toner purification system has been devised featuring only a single, much smaller separator. This new approach is based on directly attacking the cause of toner disposal, i.e. contamination.

Liquid toners fail eventually with usage due to the fact that the electrical conductivity of the clear phase increases. This allows the latent charge image to be neutralized without attracting as many colored toner particles, i.e. the image starts to fade away. It is believed that ionic contaminants are picked up largely from the dielectric paper and these colorless ions, when dissolved in the carrier fluid, impart electrical conductivity which "competes" with the colored particles in neutralizing the latent charge image. When the image density, i.e. color intensity, falls to an unacceptable level, the toners must be discarded.

A salient characteristic of an electrophoretic separator is that these contaminating ions are removed along with the charged toner particles. This is, fundamentally, a purification process which results in lowering the electrical conductivity of the clear phase.

The present invention is based on the fact that the contaminating ionic species build up slowly during printing/plotting. Typically, about 2500 color passes can be made before image fading forces the user to throw out the toners. Thus, if a small fraction of the toner is sent through a separator after each toning pass and the resulting sludge discarded, the contaminant build-up stays within acceptable limits indefinitely. The toners never have to be discarded. The purified carrier fluid is simply returned to the toner tank so that little liquid is lost. Toner concentrate must be added in order to replace the colored particles carried out with the toned image as well as those discarded in the sludge.

Typically, about 3 cc. of toner must be purified after each toning pass in order to keep the contaminant concentration in the toner at a negligible level. Thus, a single toning pass results in: (1) the introduction of a small amount of contaminant into the toner tank. This comes primarily from the paper surface; (2) the carry-out of a smaller amount of contaminant with the residual fluid on the plot; (3) the removal of a small amount of contaminant along with some toner particles when the 3 cc, or so, of toner is purified. In the steady state, the net change in contaminant level is zero, i.e. the amount in (1) above equals the sum of (2) and (3). Thus the contamination is no worse after the toning pass than before it. The toner can be used indefinitely with no further increase in contaminant level.

In accord with the present invention, a first color toner is circulated to the toning shoe or applicator head for toning of a latent electrostatic image on support medium. After toning is completed, a small volume of toner fluid is left behind in the applicator head. Next, wash fluid is pumped through the applicator head, displacing and mixing with the volume of toner which was left behind. This "dirty" wash fluid is purified by separating contaminants and colored particles in a purifier or separator and the purified wash fluid is returned to the wash fluid tank. The capacity and size of the separator can be small since a relatively long time is available for purification during the next color pass.

When washing of common volumes is complete, a small volume of fluid consisting entirely of wash fluid is left behind in the applicator head. Next, toner is again circulated to the applicator head, displacing and mixing with the volume consisting entirely of wash fluid. This second volume of wash fluid is returned to the toner tank, along with the toner, slightly diluting the material in the tank. This procedure continues for each color of a color toning process. Circulation of toner and wash fluid may be solely by a pump or may be by a combination of a pump or air blower. It will be seen that as continuous purification of the wash fluid occurs, dilution of toner with purified wash fluid will require the addition of excess concentrate. The required quantity of excess concentrate is small, however, typically several times smaller than the normal concentrate which is added to replace colorant carried out with the paper as visible imaging. The system is otherwise closed, requiring no regular disposal of toner and using only a small purifier or separator. In another embodiment involving monochromatic toning only one toner tank is employed. In this case, wash fluid is not needed, and the purifier merely operates on small samples from the toner tank, but on a recurring basis, one sample after another.

Modern, efficient liquid toning systems can use relatively dilute toners containing about 0.5% solids by weight. Thus, the purification of 3 cc (=2.25 grams) of such toner results in the removal of only about 0.01 gram of solid particles which must be discarded. About 2000 such toning passes can be done before a single ounce of sludge is accumulated. This waste is in the form of a slurry containing about 30% liquid by weight. Thus, some 2000 color passes can be made before an ounce of this slurry must be discarded.

BEST MODE FOR CARRYING OUT THE INVENTION

Figure 1:
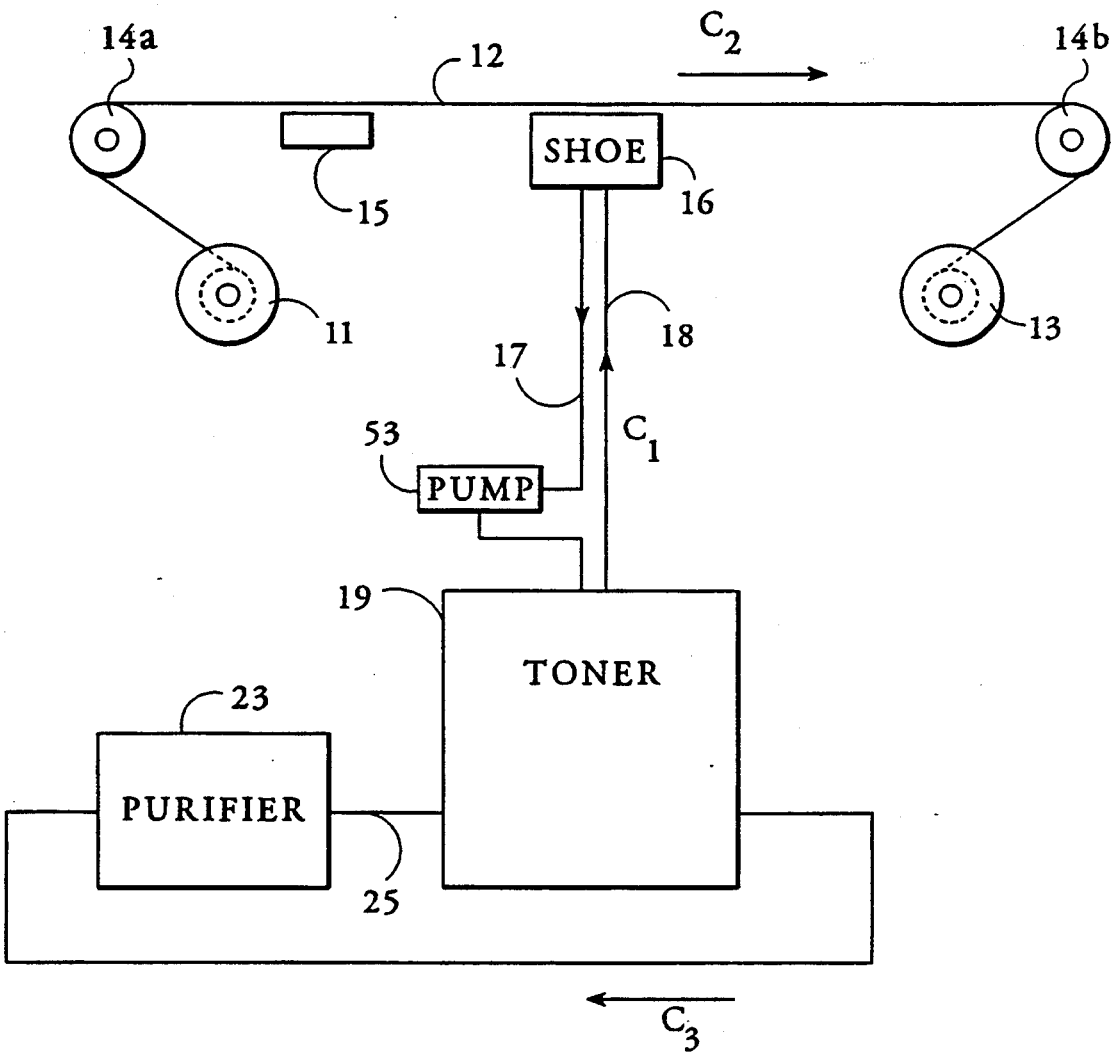
FIG. 1 is a plan view of a single toner tank embodiment of the present invention.

With reference to FIG. 1, a paper supply roller 11 is spaced apart from a takeup roller 13 with a web of paper 12 maintained in tension between the rollers, using idlers, including paper turning idlers 14*a* and 14*b*. The supply and takeup rollers are powered by servo controlled motors, not shown, which can accurately position the paper. An electrostatic writing head 15 applies a latent image to the paper, relying upon careful monitoring of the paper position. A toner applicator, called a toning shoe 16, applies toner to the latent image, developing it and making it visible. The toning shoe is preferably a full width applicator, spanning the width of the paper. Liquid toner is supplied to the applicator and flows across the entirety of an exposed applicator surface allowing toner particles to adhere to charged regions of the paper.

The writing head 15 is of the scanning type, moving across the width of the paper, similar to scanning heads of dot matrix printers. However, instead of applying ink to paper by means of a ribbon, the head, having an array of closely spaced wires connected to high voltage supply, merely deposits an electrostatic charge in an analogous manner, thereby writing a latent image.

Toner is supplied to the toning shoe by a pipe 17 from a toner supply reservoir 19. Excess toner is returned to the reservoir from the toning shoe by means of a return pipe 18. A small amount of contaminants, $C_1$, is returned to the toner tank. The contaminants are the previously mentioned ionic species picked up from the paper which are generally colorless charged ions in solution, but which compete with toner particles. Other such contaminant species $C_2$ remain with the paper. A pump 53 draws toner from reservoir 19 for maintaining a continuous flow of toner during a toning cycle. A small amount of toner $C_3$ from the reservoir or directly from the return line 18 is cycled through a purifier 23 at approximately 3 cc per color pass. The function of purifier 23 is to electrophoretically deposit ions onto the moving surface of a drum. Toner particles will also be removed so that the output of the purifier 23, fed back to toner reservoir 19 along pipe 25, is purified liquid toner carrier. This will require a small amount of excess toner concentrate to be added from time to time. In the case of a single toner tank, the present invention calls for repeatedly sampling the toner tank to remove contaminants, rather than attempting to purify the entire stream of used toner, as in the prior art. The continuously repeated sampling method allows a small purifier or separator to be used, even though a modest amount of good toner particles is discarded.

Figure 2:
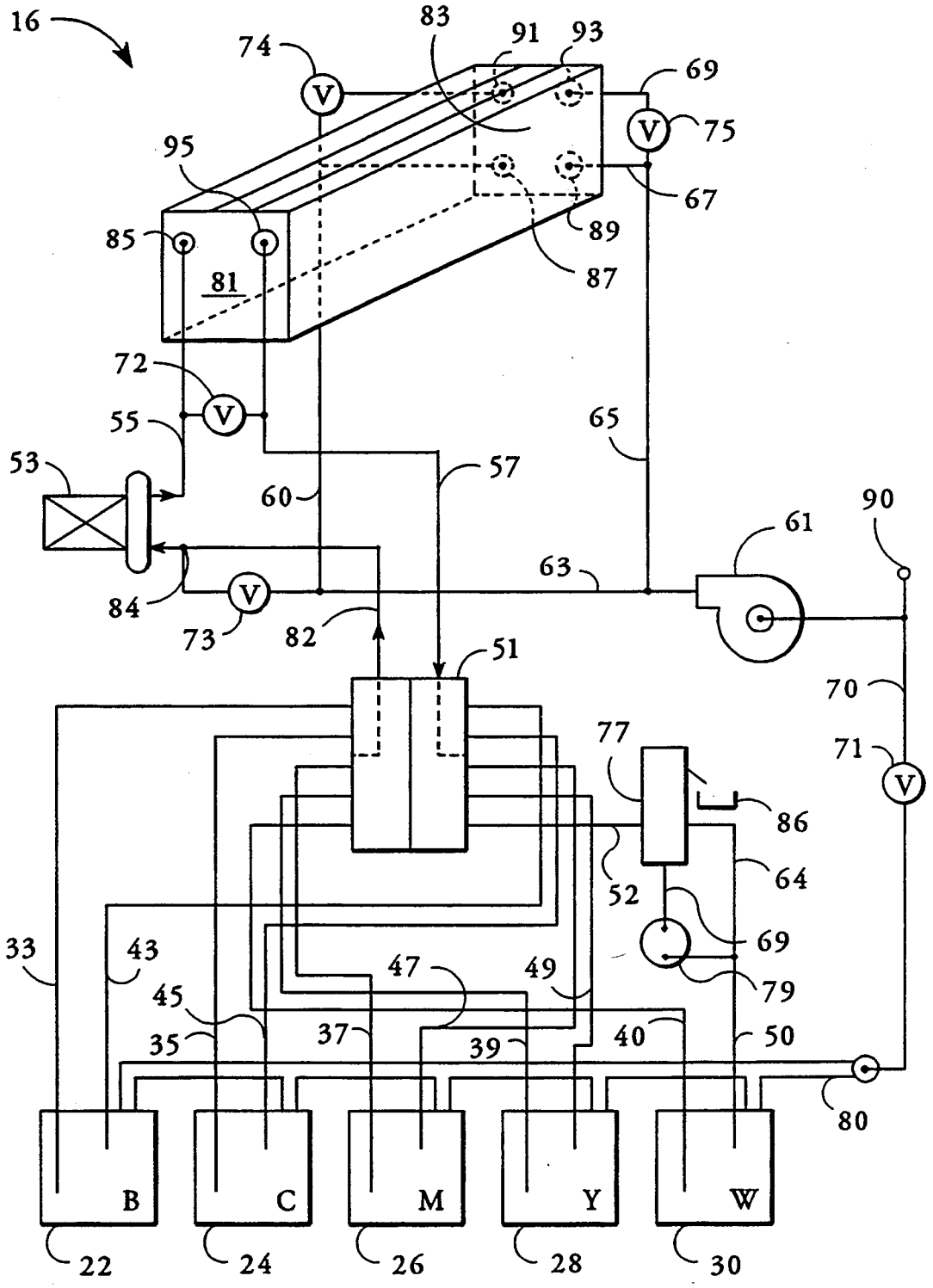
FIG. 2 is a plan view of a multiple toner tank embodiment of the present invention.

With reference to FIG. 2, color toning requires a plurality of toner tanks. Toning occurs during a series of passes of the paper, not shown, past the toner applicator 16. Toner is supplied by a plurality of toner supply vessels including a vessel 22 for black, a vessel 24 for cyan, a vessel 26 for magenta and a vessel 28 for yellow. A fifth vessel 30 is used to contain wash fluid, such as isopar. Vessel 22 includes a supply line 33 and a return line 43. Vessel 24 includes a supply line 35 and a return line 45. Vessel 26 has a supply line 37 and a return line 47. Vessel 28 has a supply line 39 and a return line 49. Vessel 30, supplying wash fluid, has a supply line 40 and a return line 50. All of the aforementioned supply and return lines are connected to a selector valve 51 which allows one of the supply vessels to communicate with the toner applicator 16 at one time. At different times, each of the other vessels may be brought into communication with the toner applicator.

The toner supply path 82 from selector valve 51 to toner applicator 16 involves a common passageway using a small diameter hose of approximately one quarter inch inside diameter leading to the single pump 53. From pump 53 a similar hose of small diameter 55 is connected to toner applicator 16 forming a supply path. A toner return path is provided by hose 57 which joins the toner applicator 16 to selector valve 51 without passing through the pump.

An optional, but preferred, high velocity air supply means, such as blower 61 provides a more efficient means of purging toner lines than the pump 53, but is not required. An air jet in a conduit 63 of large inside diameter, approximately five-eighths inch, joins the air supply means to liquid pump 53. Air blower 61 is preferably an RDC Revaflow Blower Model RDC12HH, manufactured by EG&G Rotron; Saugerties, N.Y. Another conduit 65, similar to conduit 63, is connected from the air supply means 61 to the toner applicator 16 through first and second conduit branches 67 and 69. Second branch 69 includes air valve 75 which is opened for air jet purging of applicator 16. Another air conduit 60 connects conduit 63 to applicator 16 through air valve 74 which is used for air jet purging of a different part of applicator 16. Air valves 74 and 75 are thus opened in order to thoroughly purge and expel liquid from separate internal passages of applicator 16. Air valves 74 and 75 may be opened for air jet purging simultaneously or they may be opened sequentially. Sequential opening provides maximum air flow through a selected internal passage of applicator 16.

Air return line 70 connects the input of air supply means 61 to common air collection manifold 80 through air valve 71. Liquid toner return lines 43, 45, 47, and 49 and wash fluid return line 50 carry a mixture of liquid and air to selected tank 22, 24, 26, 28, or 30 from selector valve 51. The selected tank serves as a separator so that the air rises to the top of the tank and the liquid falls to the bottom. Common air manifold 80 causes a slight air pressure reduction above the liquid of all five tanks as air is drawn by air supply means 61 through conduit 70 connected to common air return manifold 80. In this way the air which has been separated by rising to the top of a tank is returned and recirculated through applicator 16 and pressure build-up in the tank is prevented. First valve 71 is positioned in air return line 70 and is kept open during both the toning and purging operations. Valve 71 is closed only temporarily when loading paper onto a drum or take-up spool before writing or toning begins. By closing valve 71 the suction of air supply means creates a partial vacuum at port 90 which is connected by means not shown to a drum or take-up spool also not shown.

A fourth air valve 72 is positioned to short circuit the hose supply line 55 to the hose return line 57 in order to provide a low resistance return path for purged fluids without passing through the liquid pump 53 which would restrict the high velocity flow. This short circuit path also permits the liquid pump to remain running during fluid purging so that residual liquid within liquid pump 53 is purged and returned to selector valve 51 through open valve 72. At the same time, opening fifth air valve 73 provides high velocity air for forward purging of the running liquid pump 53 through valve 72. Opening fifth valve 73 also provides high velocity purge air for reverse purging of the liquid supply line connecting the input of liquid pump 53 to selector valve 51. The selector valve 51 connects with selected toner supply line 33, 35, 37, or 39 or with wash fluid supply line 40. In this way the selected fluid supply line, the selector valve, the liquid pump input line, the liquid pump, the applicator supply line 57 and the applicator itself are all effectively purged of liquid. Air valve 74 and air valve 75 are opened as described above to supply purging air to the applicator 16, except that a small volume of fluid is left behind.

In accord with the present invention a first small volume, approximately 3 cc, of spent toner is left in the applicator prior to the introduction of wash fluid. As wash fluid is introduced into common volumes including the applicator head, the spent toner is mixed into the wash fluid which is then purified in purifier 77, and the purified carrier fluid is sent to the wash fluid tank. A similar second volume of wash fluid, about 3 cc, is left in the applicator when the wash cycle is complete. As toner is introduced, the second volume of wash fluid is mixed into the toner causing minor dilution thereof. This shifting of spent toner and clean wash fluid balances volumes so that neither the toner tank nor the wash fluid tank accumulate excess fluid volume. This procedure is discussed below.

A mixture of air and wash fluid is carried to purifier 77 through hose 52 from valve block 51. A tank, not shown, separates the air and the wash fluid from each other. The air is then carried through hose 64 to return line 50 and to the wash fluid tank 30. Within purifier 77 the wash fluid is separated into purified carrier fluid and sludge which contains the colored toner particles, a minor amount of carrier fluid and, presumably, the harmful contaminants. The purified fluid is carried through line 69 to return line 50 and to wash fluid tank 30. The sludge falls into sludge tray 86 for periodic disposal. Liquid return line 69 may include a filter cartridge 79 which serves to remove paper fibers or other debris from the carrier fluid. Cartridge 79 may be replaced periodically during system maintenance.

Following is a sequential description of the procedures required to make a full color print and leave the system in a clean condition:

First, with liquid pump 53 off, valves 72, 73, 74, and 75 closed, air supply means 61 running and selector valve connected to black toner supply tank 22 by means of toner pickup line 33 and return line 43, close normally open air valve 71 to create a partial vacuum at port 90 so as to load paper onto a drum or onto take-up spool, not shown. After paper is attached open air valve 71 so as to start airflow through toner applicator 16. If needed for paper retention on the spool or drum, air return line 70 may be of smaller diameter than air supply line 63 so as to provide a slight flow restriction and keep a slight vacuum at port 90. As an example, line 70 may have an internal diameter of one-half inch for this purpose.

After paper is loaded and air recirculation started begin forward paper motion towards spool 13 and, at the same time begin writing by applying writing voltages to scanning writing head 15 and start liquid pump 53 so as to deliver black toner to applicator 16 before latent image bearing paper reaches applicator. Normally the paper web is stationary during one head scan transit and then the paper is advanced before beginning the next head "scan". During this first "black" pass, the latent image is created at scanning write head 15 and rendered visible by toning at applicator 16. Air supplied by means of conduit 67 from conduit 65 and air supply means 61 passes over a "knife" edge within the applicator so as to remove excess liquid from the paper web. Such an "air knife" is described in U.S. Pat. No. 4,870,462 to G. F. Day. This air knife liquid removal results in a mixture of black toner and air exiting applicator 16 through return line 57 to selector valve 51 and thence to black toner tank 22. Within tank 22, the air is separated from the liquid and returned by means of common manifold 80 for continuous recirculation. After completion of the black imaging pass open valves 72, 73, 74 and 75 while running liquid pump 53 so as to thoroughly purge the black toner from the entire system as described above. Valves 74 and 75 may be operated sequentially as described above so as to more thoroughly purge internal passages in applicator 16. Begin paper re-wind in preparation for the next, "cyan" color pass. Select wash fluid supply line 40 and wash fluid return line 50 using selector valve 51 then close air valves 72, 73, 74, and 75 after paper re-wind is complete so as to thoroughly wash the common volume with clean wash fluid and thus remove all black toner particles from the common or shared volume. As described below the dirty wash fluid is collected in purifier 77 for cleaning by means of an electrophoretic separator shown as 77 in FIG. 3. After washing is complete, reopen air valves 72–75 so as to purge the residual wash fluid from the common volume and return it to the wash fluid tank 30. Begin the cyan write pass by scanning the write head 15 and applying write voltage to create the cyan latent image on the paper web 12. Before the cyan latent image reaches the applicator 16 select the cyan supply and return lines 35 and 45 using select valve block 51 and close air valves 72–75 so as to supply cyan toner to applicator 16 in order to render visible the cyan image. Note that the liquid pump 53 and the air supply means 61 remain running during the entire process.

Repeat the above process for cyan, magenta, and yellow imaging. After purging of the wash fluid following the final, yellow imaging pass the entire system is clean and the system may be shut down by first turning off the liquid pump 53 then the air supply means 61. Note that the liquid pump 53 is never operated unless the air supply means is in operation. A principal reason for this is that toner and wash fluid containment in the applicator is by means of an air curtain completely surrounding the liquid in the area of the applicator in contact with the paper.

In FIG. 2, a full-width toner applicator 16 may be seen to have an elongated structure with a first end 81 and a second end 83. Fresh toner enters applicator 16 via entry port 85 at end 81 and travels across the full width of the applicator via an internal cross-channel, not shown, which is connected to port 85. A longitudinal slit delivers the fresh toner to the upper face of the applicator where it tends to spread out and contact the latent image bearing paper web. At the same time air is delivered to the applicator via entry ports 87 and 89 where the air serves to prevent leakage of liquid toner around the upper edges of the applicator as well as to remove by means of an air knife, not shown, the excess liquid from the paper web. The air ports 87 and 89 always supply air to the applicator in contrast to ports 91 and 93 which deliver air to the applicator only when valves 74 and 75 are opened for liquid purging. Valve 72 is opened if either valve 74 or 75 (or both) is opened. The result is that most liquids are driven by the air jet to the left and out of the applicator and, via return line 57 back to the selector valve 51 from where they are returned to the corresponding liquid tank. An exception is a small volume of liquid left in the applicator at the end of a cycle, discussed below. Gravity then separates the liquid from the air within the tank 22, 24, 26, 28, or 30 so that the air may return to the air supply means via the common manifold 80, open valve 71 and air return line 70. There is always an abundant supply of air which is adequate to supply several needs simultaneously although separate opening of the air valves 74 and 75 will allow somewhat more thorough liquid purging of the internal channels of the applicator.

Port 95 at the left end 81 of the applicator 21 serves as a drain means during toning while purging valves 74 and 75 are closed. A mixture of air and used toner from the air knife, which is disposed along an upper edge of the applicator, is delivered to port 95 and thence to return line 57, selector valve block 51 and then to the corresponding liquid tank wherein the liquid is stored and the air separated for recirculation as described above.

The longitudinal channels in the applicator which are connected to ports 87 and 89 remain dry and free of liquids at all times so long as air pressure is supplied via these ports while the liquid pump 53 is running. Provided the air supply means 61 is started before starting the liquid pump 53 and allowed to operate until a short time after the liquid pump 53 is shut down, the channels connected to ports 87 and 89 will remain in a dry state and not require liquid purging. For this reason the left end of the applicator in FIG. 2 shows no purging ports corresponding to air supply ports 87 and 89 on the right side of the applicator. There are no valves in the air supply lines connecting air supply means 61 with air supply ports 87 and 89. Such valves, if existent and closed, might allow liquids to enter the channels responding to ports 87 and 89 and this would enlarge the purging task unnecessarily.

Toner in the toner supply channel connected to port 85 will be blown during purging, i.e. when valves 72 and 74 are open, backwards in the direction opposed to its normal flow via open valve 72 into return line 57. At the same time valve 73 is opened thus supplying abundant jet air to toner supply line 82 at junction 84. From junction 84 the air moves both left and right, i.e. in the normal toner flow direction to the left and opposed to normal toner flow to the right. To the left the jet air assists in purging all liquid from the still running liquid pump 57 and, via open valve 72 the air assists the return of this purges liquid to return line 57 and back via selector valve block 51 to the correct supply tank. Jet driven air moves from junction 84 in opposition to the normal toner flow direction and pushes the liquid backward through the toner supply line 82 to the selector valve block 51 to a selected liquid supply line 33, 35, 37, 39, or 40 backwards to the correct tank.

During liquid purging a mixture of air and liquid enters the selected tank through both the selected toner supply line and the selected return line 43, 45, 47, 49, or 50. Thus all purged fluids will wind up in the corresponding liquid tank via selector valve block 51 whether they return via the corresponding supply line or the air/liquid return line. By this arrangement of valves and lines, the common volume is air jet purged so as to minimize toner fluid mixing and allow a single full-width applicator to be used for all colors. By controlling the air jet purging time a desired small amount of liquid can be left in the common volume.

For the purpose of this invention a small volume of spent toner and contaminants is left in the applicator head. The volume is about 3 cc. This volume is sent to purifier 77 through selector valve 51 when wash fluid is pumped into the applicator. After purification, wherein charged solids and contaminants are removed, the remaining fluid is returned to the wash fluid tank. Washing is done when the selector valve 51 is actuated so as to select wash fluid and the air valves 72, 73, 74, and 75 are closed allowing the pump to draw wash fluid from wash fluid tank 31 via wash fluid supply line 40, selector valve block 51, and liquid supply line 82 to liquid pump 53. From pump 53 the wash fluid is forced by pressure through the same paths as was the preceding toner during toning of the latent image. The wash fluid picks up and mixes with the small amount of residual toner and contaminants remaining after air jet purging and returns the colored particles and contaminants via drain line 57, selector valve 51, and wash the fluid return line 52 to the purifier 77.

With liquid pump 53 and air supply means 61 still running, clean wash fluid is purged from the entire common volume by opening valves 72–75 and returned to the wash fluid tank 30 via supply line 40 and return line 50 just as described above for a colored toner except that a portion of this clean fluid passes through line 52 and purifier 77 before returning to wash fluid tank 50. Even though purifier 77 is not needed to further purify this already clean wash fluid, no harm is done by passing it through purifier 77.

A small volume of clean wash fluid is left in the common volume by controlling the wash fluid purging time. This small volume, typically 3 cc, is made to be essentially equal to the volume of toner which was left in the common volume after toner purging. This small volume of clean wash fluid is automatically mixed with the next toner upon its introduction into the common volume where it acts, on the average, to replace the toner fluid which was lost when that toner was last used. Each wash cycle then causes about 3 cc of clean wash fluid to be transferred from the wash fluid tank 30 to a toner tank whereas each toning pass results in about 3 cc of fluid being transferred from that toner tank to the wash fluid tank. The fluid volumes thus stay in balance so that no tank becomes overfilled.

The small amount of colored solids lost during washing and wash fluid purification is replaced along with the colored solids carried out with the toned image. Typically, the toner solids "wasted" due to disposal of the sludge are only a small fraction of the colored solids used for visible image formation.

Figure 3:
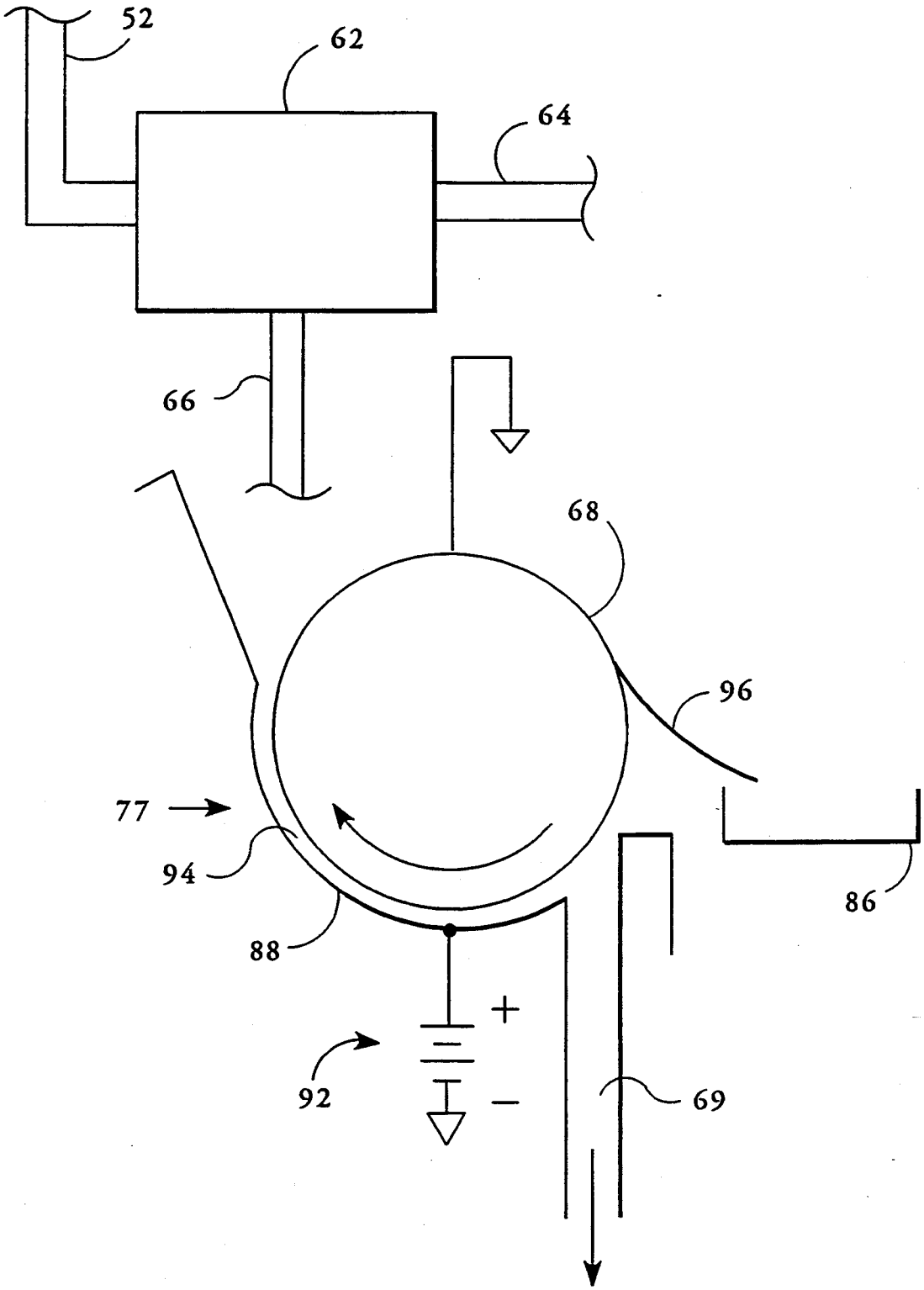
FIG. 3 is a plan view of a separator or purifier of the type shown in FIGS. 1 and 2.

With reference to FIG. 3 a purifier 77 is shown in more detail. A mixture of dirty wash fluid and air enters liquid-air separator tank 62 through conduit 52. Separator tank 62 is large enough to hold the total volume of wash fluid used during one wash cycle, typically 0.1 to 1.0 liters, so that none of the wash fluid returns to the wash fluid bottle 30 of FIG. 2 except through electrophoretic separator or purifier 77. Within the separator tank 62, gravity causes the liquid to collect at the bottom of the tank while air rises to the top. The liquid drains into electrophoretic separator 77 while the air returns to wash fluid tank 30 of FIG. 2 through conduit 64. The rate of liquid flow into electrophoretic separator 77 is controlled by adjustable valve means, not shown, or by the diameter of drain pipe 66. In this way the rate of liquid purification can be minimized and the size and cost of electrophoretic separator 77 minimized. The time required for washing is, typically, only 2 to 8 seconds while the time for a color writing pass is the order of one minute. The volume of wash fluid within the electrophoretic separator 77 at any point in time may be only five times as large as the small volume of spent toner left in the applicator head. The wash fluid purification can occur slowly as it need not be complete until washing of the toner shoe is needed again after the next color pass. The separator tank 62 thus serves as a wash fluid ballast which holds the dirty wash fluid and supplies it continuously and relatively slowly to the electrophoretic separator 77. In this way the size and cost of the electrophoretic separator 77 can be much less than if the wash fluid had to be purified during the wash cycle itself. In an alternative embodiment the air might not be used for liquid purging of the applicator shoe but the wash fluid introduced directly to clean the shoe. In this case return air line 64 would not be needed and tank 62 would not serve to separate the liquid and the air. Tank 62 would, in this case, serve only as a holding tank for the wash fluid to be purified.

Electrophoretic separator 77 consists primarily of rotating accumulator drum 68 and repelling electrode 88 which are separated by narrow gap 94 through which the liquid passes during purification. Typically, drum 68 may be 1 to 3 inches in diameter and length while gap 94 separates repelling electrode 88 from drum 68 by 0.010 to 0.050 inches. The gap length around drum 68 may correspond to a length of 60 to 180 degrees of arc. Voltage source 92, typically 600 to 4000 volts, biases repelling electrode 88 relative to electrically grounded drum 68 so as to result in plate-out of all toner particles onto drum and removal of conductive ionic species from the clear carrier fluid. The exact nature or identification of the undesired ionic species is not known, but the purification process is found to result in lower electrical conductivity of the clear fluid as desired to prevent toner conductivity increase and to preserve color fidelity.

The rotation rate of drum 68 is adjusted so as to minimize clear fluid carry-out with the slurry but fast enough to prevent a highly insulating layer of toner particles from building up on the drum. Such a build-up of an insulating toner layer can result in failure of the electrophoretic separator, i.e. the liquid is incompletely purified or it can result in destructive electrical breakdown effects. The rate of rotation depends on many parameters such as wash fluid quantity and contamination level, exact nature of the selected toner chemistry, electrophoretic separator size, and repelling voltage level, etc., but it is typically in the range 0.1 to 10 revolutions per minute.

Scraper blade 96 fits closely with the smooth drum surface so as to effectively remove all solids and residual liquids from the drum surface leaving a clean surface to pass in close proximity to repelling electrode 88. The materials which are scraped from drum 68 are collected in catch tray 86 or other container for disposal.

The purified fluid passes through conduit 69 and wash fluid return line 50 of FIG. 2 to wash fluid tank 30, also shown in FIG. 2. Optionally, filter cartridge 79 may be inserted in conduit 69 for the purpose of filtering out any paper fibers or uncharged pigment not removed from the wash fluid by electrophoretic separator 77.

It should be realized that other forms of electrophoretic separator 77 are equally possible based on alternative architectures such as a revolving disk or belt without departing from the spirit or scope of the present invention. Similarly, the moving surface could be biased to a negative voltage so as to attract positively charged toner particles while keeping the fixed electrode grounded electrically. In case of a system employing negatively charged toner particles the voltages would be reversed.

A major advantage of the present invention is that the low-flow purification rate makes possible a simplification of the electrophoretic separator itself compared to the prior art. At the high fluid flow rates of the prior art it is necessary to employ lateral edge seals to prevent dirty fluid from leaking out the sides before all contaminants have been removed. These lateral edge seals can lead to a number of reliability and maintenance problems and are, generally, troublesome. With the reduced flow rates of the present invention the lateral edge seals can simply be omitted. The fluid is then introduced near the center of the drum 68, i.e. about half-way between its two lateral edges rather than spread out uniformly along the cylindrical drum surface. The fluid is then allowed to leak out the edges but the slow fluid velocity insures complete removal of all contaminants before the clear fluid spills out of the electrophoretic separator. In this case a bucket or funnel, not shown, is needed to collect the fluid and send it through conduit 69.

Figure 4A:
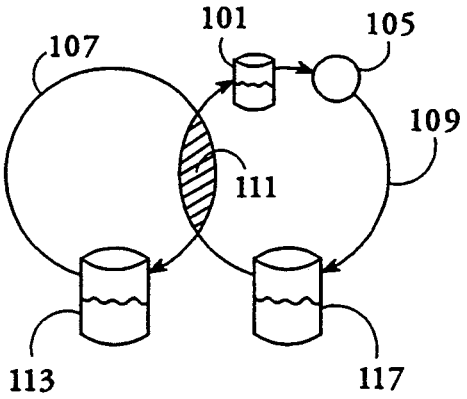
FIGS. 4*a*–4*e* are toner and wash fluid circulation plans for different embodiments all in accord with the present invention.

The above embodiment is represented schematically in FIG. 4*a* where the small reservoir 101 is a holding tank which can be combined with separator tank 62 in FIG. 3. The shaded region 111 is the common volume and the circle 105 represents a purifier, corresponding to purifier 77 in FIG. 2. A first volume of toner is circulated from toner reservoir 113 in the left loop 107 through the shaded common volume 111. Some contaminated toner is left in the common volume 111 as a second volume. Wash fluid is circulated from wash fluid reservoir 117 through the right loop 109 with a third volume of wash fluid incorporating the second volume of contaminated toner. The third volume is purified and clean wash fluid is returned to the wash fluid tank 117.

Figure 4B:
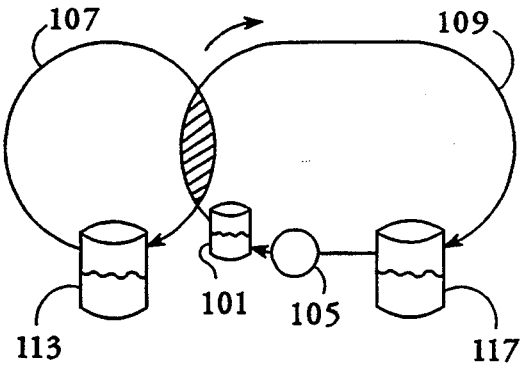

It should be appreciated that other variations of the present invention are possible. As an example, as shown in FIG. 4*d*, a simplification of FIG. 1, the contaminated wash fluid could be returned directly to the wash fluid tank 117 rather than first purified. In this case the wash fluid could be continuously purified in order to keep the contaminants within an acceptable level. In FIG. 4*d* the purifier 105 is in a sub-loop within the wash fluid loop 109. Since the purifier is not in the main wash fluid loop it may be considered to be in a parallel relation with the wash fluid tank, connected to the tank by the sub-loop. This alternative method would result in minor color cross contamination of the toners in a color printer and would, therefore, be somewhat inferior to the best method described above. It might still be preferable to the prior art, however, because of the benefit of eliminating toner disposal.

Figure 4C:
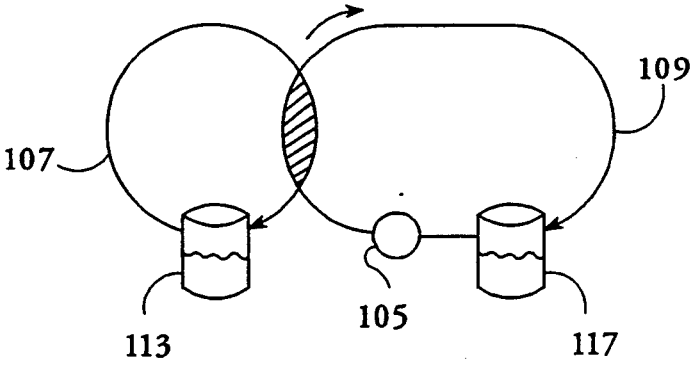
Figure 4D:
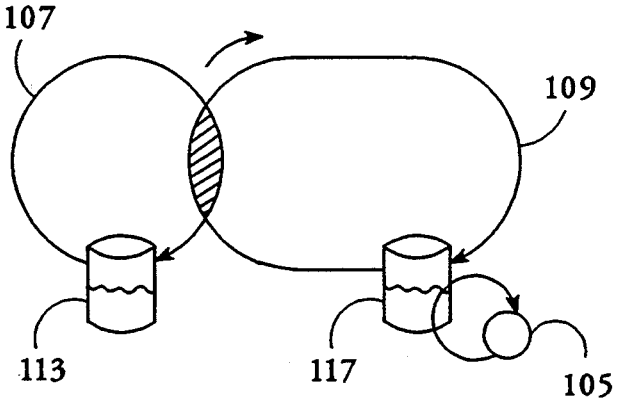

Another possible embodiment of the current invention would return the contaminated wash fluid directly to the wash fluid tank but purify the wash fluid "on-line" during transport to the applicator shoe, as shown in FIG. 4*c*. This architecture would prevent color cross contamination but would require a larger separator (electrophoretic separator) to handle the high flow rates during washing. It is felt that the optimum embodiment, but by no means the only practical one, is to collect and store the contaminated wash fluid in a holding tank for slow purification during the subsequent color pass or, for monochrome prints, the next print cycle.

To prevent purified wash fluid from building up in the wash fluid tank, in the embodiments discussed above, a small volume of wash fluid is left in the applicator at the end of each wash cycle. This clean wash fluid will be sent into a toner tank as if it were excess toner at the beginning of a toning pass. The dilution of toner in the toner tank will require the addition of toner concentrate from time to time. To prevent loss of color saturation, toner may be allowed to flow for a few seconds to drive the wash fluid out prior to toning an image.

In yet another embodiment, the dirty wash fluid could be returned directly to the wash fluid tank but a stream of wash fluid drawn slowly from the tank and purified continuously so as to fill a smaller reservoir with purified wash fluid preparatory to washing the applicator, as shown in FIG. 4*b*. The amount of purified liquid in the smaller reservoir 101 would be large enough to supply all the clean fluid needed for a wash cycle but small enough to allow a small electrophoretic separator without lateral edge seals. In this case the wash fluid supply line shown as conduit 40 in FIG. 2 would be connected with the smaller reservoir rather than with the wash fluid tank directly. This method is almost completely equivalent to the preferred embodiment which is described in detail above. A minor difference is that the main wash fluid tank would contain dirty rather than purified liquid and this could lead to minor sludge build-up in the tank. This sludge on the tank bottom might require occasional cleanup maintenance whereas the preferred embodiment would not require such service. The separator tank 62 of FIG. 3 might be subject to sludge build-up, of course, but there are two advantages in this preferred embodiment. First, the sludge would not accumulate during idle periods as the tank would be emptied completely at the end of the last color pass. Second, the introduction of new contaminated wash fluid into an empty separator tank would provide a washing action not readily available in the main wash fluid tank.

Figure 4E:
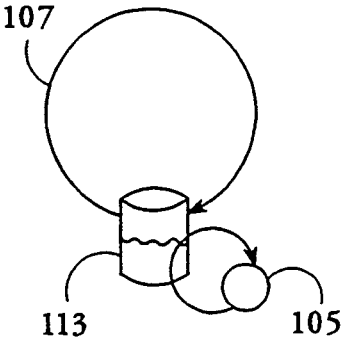

For monochrome printing or for single-pass color printing it is not necessary to employ wash fluid, as shown in FIG. 4*e*. In this case the optimum method is to purify the toner directly but at a slow enough rate to avoid excess concentrate consumption and slurry disposal. For single pass color printing a single electrophoretic separator could be used for all colors.

The present invention possesses a remarkable synergy and compatibility with the requirements of a single applicator, self-cleaning system. Although the amount of residual toner left behind in the applicator represents only a few cc's, it is sufficient to automatically accomplish the requirement of continuous purification without any additional components other than a relatively small purifier. While toner concentrate will have to be replaced somewhat more frequently than in a total recycling system, the advantages gained by using a single small purifier or separator outweigh the cost of the fresh chemicals required by the system. The added cost of chemicals is tiny compared to the compound benefits of eliminating three of four purifiers, all lateral edge seals, and, especially, the need to dispose of large volumes of spent toners or concentrates.

I claim:

1. A method of continuous liquid toner decontamination for electrostatic printers and copiers comprising, circulating a first volume of liquid toner from a toner supply tank through a common volume, including an applicator where contaminants and spent toner are introduced into the first volume prior to circulation back to the toner supply tank for each toning pass, leaving some contaminants and toner in the common volume as a second volume, said second volume being at least 3 cc, circulating wash fluid from a wash fluid supply tank through the common volume after each toning pass, removing said second volume within a third volume consisting of wash fluid mixed with the second volume, purifying said third volume before completing a subsequent toning pass, and returning the third volume to the wash fluid supply tank.

2. The method of claim 1 wherein purifying the third volume occurs while the third volume is en route to the wash fluid supply tank.

3. The method of claim 1 further defined by returning the third volume to the wash fluid supply tank prior to purifying and withdrawing a fourth volume from the wash fluid supply tank, containing a dilution of the third volume in the wash fluid, while purifying the fourth volume containing the third volume and circulating purified wash fluid from said fourth volume.

4. The method of claim 3 further defined by purifying the fourth volume and storing an amount of purified wash fluid needed for circulation after the next toning pass.

5. The method of claim 3 further defined by purifying the fourth volume in a path from the wash fluid supply tank to the applicator.

6. The method of claim 3 further defined by purifying the fourth volume in a path from the wash fluid supply tank back into the same tank.

7. A method of liquid toner decontamination for electrostatic printers and copiers comprising, circulating a first volume of liquid toner from a toner supply tank through a common volume, including an applicator where contaminants and spent toner are introduced into the first volume prior to circulation back to the toner supply tank for each toning pass, leaving some contaminants and toner in the common volume as a second volume, removing the second volume within a third volume comprising wash fluid mixed with the second volume, to the toner supply tank, and purifying a third volume not exceeding five times the second volume, before starting the next toning pass.

8. An apparatus for continuous purification of liquid toner for electrostatic printers and copiers comprising, a toner loop having a toner applicator, a toner tank and conduit means for supplying toner from the toner tank to the applicator and returning excess toner to the toner tank, a wash fluid loop having a wash fluid tank and conduit means for supplying wash fluid from the wash fluid tank to the applicator and returning wash fluid to the wash fluid tank, the wash fluid loop and the toner loop having a common volume, and a purifier means associated with said wash fluid loop for separating charged particles from wash fluid, thereby purifying the wash fluid, the purified wash fluid delivered to the wash fluid loop, and means for causing fluid flow first in one of said toner loop and said wash fluid loop and then the other on a continuous basis until toning is complete, wherein said purifier means follows the wash fluid tank in the wash fluid loop.

9. An apparatus for continuous purification of liquid toner for electrostatic printers and copiers comprising, a toner loop having a toner applicator, a toner tank and conduit means for supplying toner from the toner tank to the applicator and returning excess toner to the toner tank, a wash fluid loop having a wash fluid tank and conduit means for supplying wash fluid from the wash fluid tank to the applicator and returning wash fluid to the wash fluid tank, the wash fluid loop and the toner loop having a common volume, and a purifier means associated with said wash fluid loop for separating charged particles from wash fluid, thereby purifying the wash fluid, the purified wash fluid delivered to the wash fluid loop, and means for causing fluid flow first in one of said toner loop and said wash fluid loop and then the other on a continuous basis until toning is complete, wherein a holding tank follows the purifier means and the purifier means precedes the wash fluid tank in the wash fluid loop.

* * * * *